US008191336B2

(12) United States Patent
Roberts et al.

(10) Patent No.: US 8,191,336 B2
(45) Date of Patent: Jun. 5, 2012

(54) FASCIA BOARD SUPPORT DEVICE FOR ROOFING

(76) Inventors: Phillip John Roberts, Selkirk (CA); Friedhelm Werner Oberpichler, Garson (CA)

( * ) Notice: Subject to any disclaimer, the term of this patent is extended or adjusted under 35 U.S.C. 154(b) by 24 days.

(21) Appl. No.: 12/795,359

(22) Filed: Jun. 7, 2010

(65) Prior Publication Data

US 2011/0131920 A1 Jun. 9, 2011

Related U.S. Application Data

(60) Provisional application No. 61/241,189, filed on Sep. 10, 2009.

(51) Int. Cl.
*E04D 15/00* (2006.01)
*E04F 21/00* (2006.01)
*E04G 21/14* (2006.01)

(52) U.S. Cl. ..... 52/749.1; 52/93.2; 52/94; 52/702; 33/417; 269/41

(58) Field of Classification Search ..... 52/93.2, 52/94, 702, 712, DIG. 1, 749.1, 749.12; 33/423, 33/415–417; 269/143, 249, 41
See application file for complete search history.

(56) References Cited

U.S. PATENT DOCUMENTS

| | | | |
|---|---|---|---|
| 4,836,517 | A | 6/1989 | Vossler |
| 5,192,059 | A | 3/1993 | Silver |
| 5,228,667 | A | 7/1993 | Bridegum |
| 5,611,189 | A | 3/1997 | Fleck |
| 5,746,421 | A | 5/1998 | Bowerman |
| 6,240,702 | B1 | 6/2001 | Wilson |
| 6,318,711 | B1 | 11/2001 | Auston, Jr. |
| 6,513,286 | B2 | 2/2003 | Vierra |
| 6,820,868 | B1 | 11/2004 | Reymus |
| D567,070 | S | 4/2008 | George |
| D568,184 | S | 5/2008 | Rogell |

*Primary Examiner* — Brian Glessner
*Assistant Examiner* — Brian D Mattei
(74) *Attorney, Agent, or Firm* — Kyle R. Satterthwaite; Ryan W. Dupuis; Ade & Company Inc.

(57) ABSTRACT

A fascia board support device features a rafter bracket having a side member for placement against one vertical side of the rafter, and a movable member pivotally coupled to the side member for movement into and out of a deployed position in which at least a portion of the movable member depends downward on an opposing side of the roof rafter. A clamping mechanism forces the depending portion against this opposing side of the roof rafter to clamp the device thereon, at which point a fascia board support projecting from the front end of the rafter bracket can seat a fascia board. After fastening of the fascia board to the rafter, the device is easily removed by releasing the clamp, flipping the movable member over to same side of the rafter as the side member and lowering the device to withdraw the support from beneath the fastened fascia board.

20 Claims, 7 Drawing Sheets

FASCIA BOARD SUPPORT DEVICE FOR ROOFING

This application claims benefit under 35 U.S.C. 119(e) of U.S. Provisional Patent Application Ser. No. 61/241,189, filed Sep. 10, 2009.

FIELD OF THE INVENTION

The present invention relates generally to devices attachable to roof rafters to support a fascia board along ends thereof, and more particularly to devices of this type that are adjustable in order to be able to place the fascia board in the correct position for fastening in place regardless of the pitch of the rafters on which it is to be installed.

BACKGROUND OF THE INVENTION

A number of devices intended for temporary attachment to roof rafters to support fascia boards at the ends thereof during installation have been developed, as illustrated by U.S. Pat. Nos. 4,836,517; 5,192,059; 5,228,667; 5,611,189; 6,240,702; 6,318,711; 6,820,868; D567,070 and D568,184.

Among the prior art fascia board supports disclosed in these prior art references are devices that are not adjustable at all, are adjustable for different fascia board sizes but not for different roof pitches, only generally support the fascia board without positioning it in the proper position and orientation for fastening to the rafters, require nailing to rafter for the temporary attachment thereto and thus require significant effort to detach after use, require installation on the rafter from specific directions that may be awkward for the installer, include user adjustable features that require visual alignment and fine tuning by the user, and include several adjustable features each requiring user input and therefore take significant time to install.

Accordingly, it is desirable to provide a fascia board support device that is flexible for use on roof rafters of different pitches while being user friendly by allowing easy installation and removal of the device and achieving proper positioning of the fascia board upon placement in the device for fastening to the rafter without further manual positioning of the board.

SUMMARY OF THE INVENTION

According to a first aspect of the invention there is provided a fascia board support device for removable attachment to a roof rafter adjacent an end thereof to support a fascia board during attachment thereof to said end of the rafter, the device comprising:

a rafter bracket comprising:

a side member presenting a flat face for placement against one vertical side of the roof rafter; and a movable member coupled to the side member through a pivotal connection and pivotally movable relative to the side member about a pivot axis parallel to the flat face thereof into and out of a deployed position in which at least a portion of the movable member projects downward below the pivot axis at a lateral distance from the side member to depend downward on an opposing side of the roof rafter;

a clamping mechanism carried on the rafter bracket and operable to tighten toward the side member from the opposing side of the roof rafter with the movable member in the deployed position to selectively secure the rafter bracket to the roof rafter; and a fascia board support carried on the side member, projecting past an end thereof and featuring a slot situated past said end of the side member and dimensioned to receive a bottom of the fascia board therein to seat the fascia board at the end of the roof rafter.

The device is easy to install on a rafter by lowering of the device from over the rafter to situate the side plate against the side of rafter and then pivoting the movable member into its deployed position on the opposite side of the rafter for completion of the bracket installation by tightening of the clamping mechanism against the rafter from this second side. No nails or other separate fasteners are required, and placement of the bracket requires no access from therebelow.

Preferably the movable member comprises first and second sections arranged to respectively project away from the side member over the roof rafter and depend downward along the flat face of the side member on the opposing side of the roof rafter with the movable member in the deployed position.

Preferably the movable member comprises a right angle member having first leg attached to the side member by the pivotal connection and a second leg projecting from the first leg at a right angle thereto at an end thereof opposite the pivotal connection.

Preferably the legs of the right angle member are planar.

Preferably the pivotal connection comprises a hinge.

Preferably the side member comprises a plate defining the flat face thereof.

Preferably the fascia board support is disposed on a side of the side member opposite the flat face thereof.

Preferably the fascia board support is selectively movable relative to the side member to change both a relative angle at which the fascia board support projects past the end of the side member and a position at which the fascia board is disposed relative to the side member in a plane parallel to the flat face thereof.

Preferably attachment point paths laid out along the side member at spaced apart positions along the plane parallel to the flat face have pairs of first attachment points thereon, each pair of first attachment points featuring a respective attachment point on each of the attachment point paths and the attachment points of each pair of first attachment points being spaced apart by a same linear distance, and wherein a pair of second attachment points defined on the fascia board support are spaced apart by the same linear distance and attachment of the fascia board support to the side member with the pair of second attachment points aligned with a respective one of the pairs of first attachment points orients the slot in the fascia board support vertically with the pivot axis at a slope matching a respective roof rafter pitch.

Preferably first attachment elements at the first attachment points are cooperable with second attachment elements at the second attachment points to facilitate fastening together of the fascia board support and the side member.

Preferably the first attachment elements comprise holes in the side member sized for receipt of fastener elements therein.

Preferably the second attachment elements comprise holes in the fascia board support for passage of the fastener elements through the holes in the fascia board when aligned with the holes in the side member at one of the pairs of first attachment points.

Preferably a fascia board seat defined in the slot of the fascia board holder is positioned to intersect an axis extending along a side of the slot opposite the side member with a plane that contains the pivot axis and is normal to the flat face of the side member at a height from the seat equal to a fascia board width.

Preferably a position along the slot at which the fascia board seat is situated can be changed by a user of the device for use with different fascia board widths.

Preferably the position of the fascia board seat along the slot is selectable only from fixed predetermined positions therealong, each of which corresponds to a known fascia board width.

Preferably there is provided a latch movable between a support position spanning across the slot in a direction parallel to a bottom of the slot at a distance therefrom and a storage position leaving the slot unobstructed, whereby the latch defines an upper fascia board seat for a first fascia board width when in the support position and the bottom of the slot defines a lower fascia board seat for a second narrower fascia board width when the latch is in the storage position.

Preferably the pairs of first attachment points are labeled with indications of the respective roof rafter pitches.

Preferably the clamping mechanism comprises a quick lock quick release clamping mechanism.

Preferably the clamping mechanism comprises a toggle clamp operable by movement of an actuating lever.

Preferably the actuating lever is pivotally secured to the side member at a position opposing the flat face thereof and the toggle clamp comprises a C-shaped arm having a first end pivotally coupled to the actuating lever, the actuating lever being pivotable into a raised position in which the C-shaped arm is pivotable over the movable member of the rafter bracket when deployed to position a second end of the C-shaped arm on a side of the depending portion of the movable member opposite the side member, the C-shaped arm having a projection extending toward the first end from proximate a second end portion of the C-shaped arm opposite the first end so that movement of the actuating lever from the raised position to a lower locking position tightens the projection against the depending portion of the deployed movable member.

Preferably there is provided a second projection carried on a central portion of the C-shaped arm that overlies the movable portion of the rafter bracket when the movable portion is deployed and the C-shaped arm is pivoted thereover, the second projection extending toward an open side of the C-shaped arm to tighten the second projection downward onto the movable member from above the rafter under movement of the actuating lever to the lower locking position.

According to a second aspect of the invention there is provided a fascia board support device for removable attachment to a roof rafter adjacent an end thereof to support a fascia board during attachment thereof to said end of the rafter, the device comprising:

a rafter bracket arranged for releasable attachment to roof rafter adjacent the end thereof and defining a flat face for placement against one vertical side of the roof rafter and a downward facing surface for seating atop the rafter when the rafter bracket; and a fascia board support carried on rafter bracket, projecting past an end thereof and featuring a slot situated past said end of the rafter bracket and dimensioned to receive a bottom of the fascia board therein to seat the fascia board at the end of the roof rafter;

the fascia board support being selectively movable relative to the rafter bracket between different predetermined pairings of position and orientation relative to the rafter bracket to change both a relative angle at which the fascia board extends relative to a plane of the downward facing surface of the rafter bracket and a position at which the fascia board support is disposed relative to the rafter bracket in a plane parallel to the flat face thereof, each predetermined pairing of position and orientation of the fascia board support relative to the rafter bracket acting to orient the slot vertically with the downward facing surface oriented at a slope corresponding to a respective rafter pitch and to position the slot such that an axis extending along a side of the slot opposite the rafter bracket intersects a plane of the downward facing surface of the rafter bracket at a height from the seat equal to a fascia board width.

While prior art devices have been developed that use markings to indicate predetermined orientations between a fascia board carrier pivotally mounted on a rafter bracket corresponding to different roof pitches, the pivotal-only movement does not act to properly position the board to align its top outer edge with the plane of the rafters top side. Once the appropriate predetermined setting for the roof pitch in question is applied and device is attached to the rafter to put the side of the slot nearest the rafter bracket at the end of the rafter, the device of the preceding paragraph positively positions the fascia board upon receipt in the slot so that the board is ready for fastening to the rafter with no need for further user-adjustment of the device or board position.

Preferably there is provided a plurality of user selectable fascia board seats each usable only at a respective predetermined position along the slot to support the fascia board, the predetermined positions each corresponding to a respective known fascia board width so that, for each fascia board seat, the axis extending along the side of the slot opposite the rafter bracket intersects the plane of the downward facing surface of the rafter bracket at a height from the seat equal to the respective known fascia board width.

Again, predefined settings minimize the degree of adjustment, fine turning and visual inspection needed in use of the device. Knowing the size of fascia board to be used and the pitch of the roof rafters, the appropriate pre-positioned fascia board seat and predetermined position and orientation of the fascia board support are selected and the device is ready for its installation on the rafter to positively position the fascia board.

According to a third aspect of the invention there is provided a fascia board support device for removable attachment to a roof rafter adjacent an end thereof to support a fascia board during attachment thereof to said end of the rafter, the device comprising:

a side member presenting a contact face for placement against one vertical side of the roof rafter; and a fascia board support carried on the side member, projecting past an end thereof and featuring a slot situated past said end of the side member and dimensioned to receive a bottom of the fascia board therein to seat the fascia board at the end of the roof rafter; and a toggle clamp comprising an actuating lever pivotally secured to the side member at a position opposing the contact face thereof and a C-shaped arm having a first end pivotally coupled to the actuating lever, the actuating lever being pivotable into a raised position in which the C-shaped arm is pivotable over a top edge of the side member to extend laterally therepast by a distance exceeding a width of the roof rafter to position a second end of the C-shaped arm on a side of the roof rafter opposite the side member, the C-shaped arm having a second end carrying a clamping feature directed toward the first end so that movement of the actual lever from the raised position to a lower locking position pulls the clamping feature toward the side member to tighten against the roof rafter from the side thereof opposite the side member.

BRIEF DESCRIPTION OF THE DRAWINGS

In the accompanying drawings, which illustrate exemplary embodiments of the present invention.

DETAILED DESCRIPTION

Figure 1:
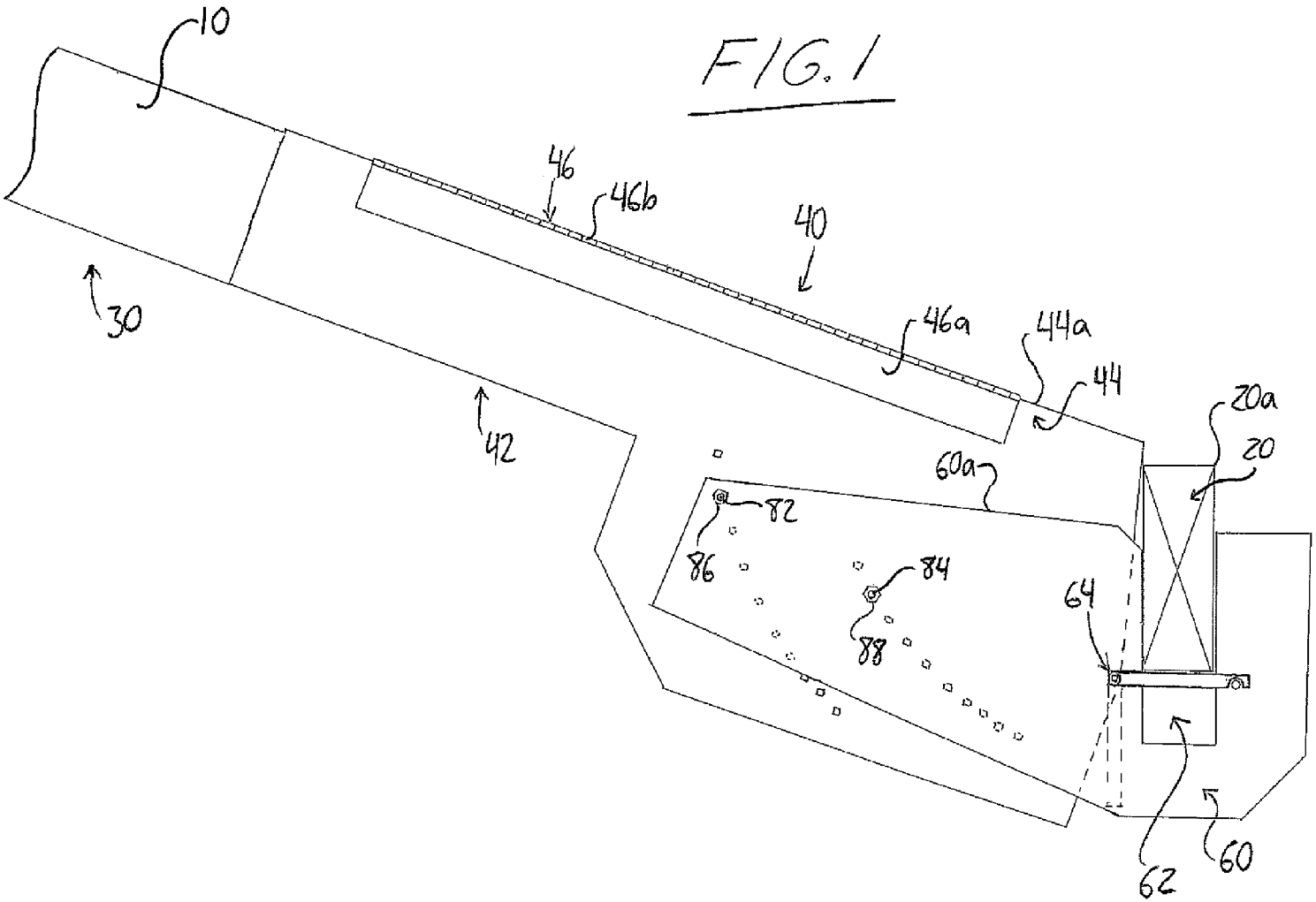
FIG. 1 is a side elevational view of a first embodiment fascia board support device in use on a roof rafter to position a fascia board for fastening to the end of the rafter.
Figures 2, 3:
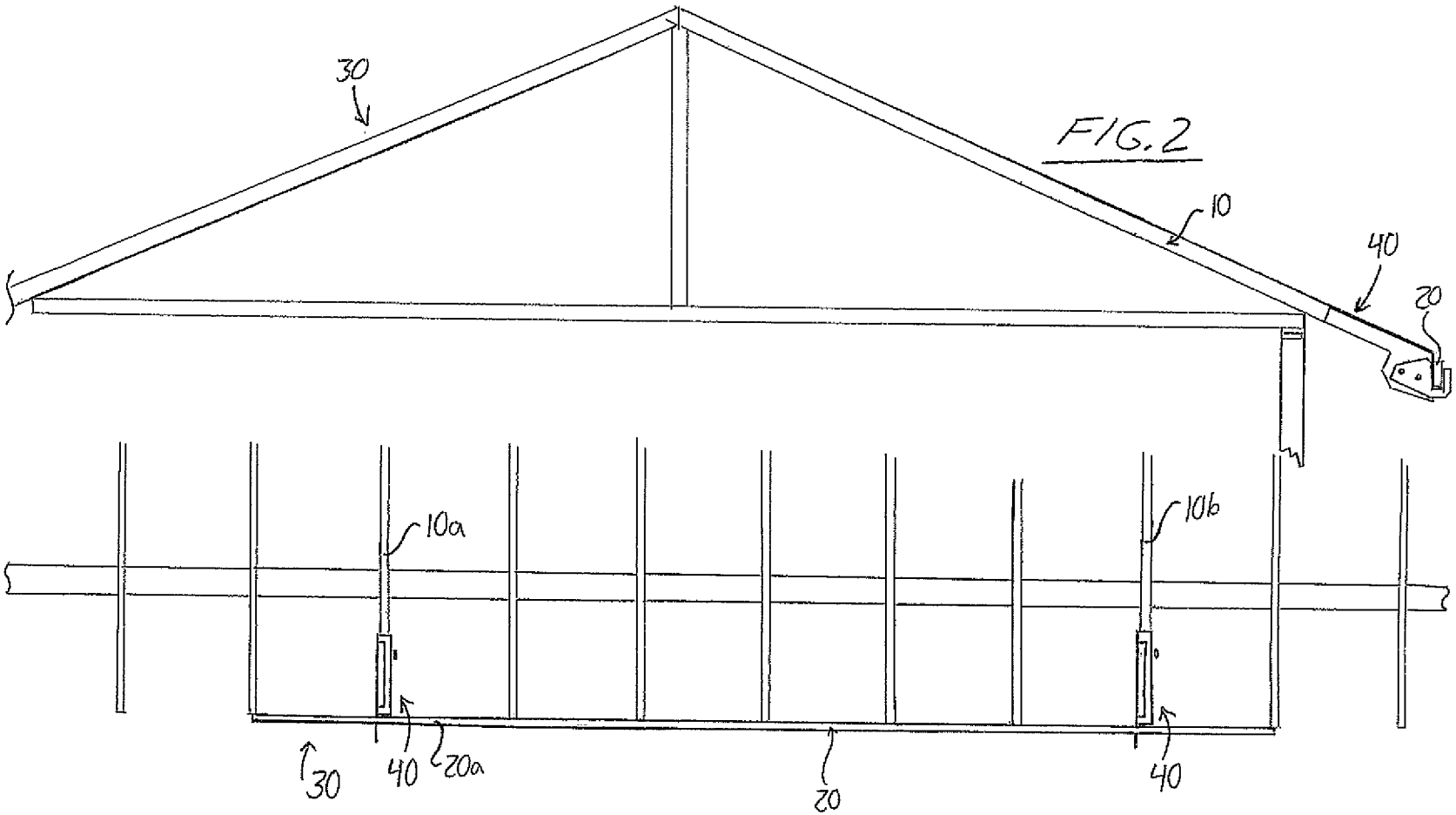
FIG. 2 is a side elevational view of use of a pair of first embodiment fascia board support devices during construction of a trussed roof structure.
FIG. 3 is an overhead plan view of a pair of first embodiment fascia board support devices during construction of a trussed roof structure.

FIG. 1 shows a fascia board support device temporarily mounted on a roof rafter 10 to support a fascia board 20 at the end of the rafter in an orientation placing a face of the fascia board flat against the end of the rafter. FIGS. 2 and 3 demonstrate how two of the devices of FIG. 1 are used in construction of a roof structure 30. In these figures, the two devices 40 are temporarily mounted on two spaced apart parallel rafters 10*a*, 10*b* defining top chords of respective roof trusses. With the two devices installed adjacent the outer ends of the two rafters 10*a*, 10*b* and set for use at the pitch angle of the roof section in which the two rafters 10*a*, 10*b* reside, they support the fascia board 20 with a longitudinal axis thereof extending horizontally and perpendicular to longitudinal axes of the rafters 10*b*, 10*b* and with the outer top corner edge 20*a* of the fascia board lying in the same plane as the tops of the two rafters 10*a*, 10*b* so that the fascia board is ready for fastening to the ends of the rafters.

Figure 4:
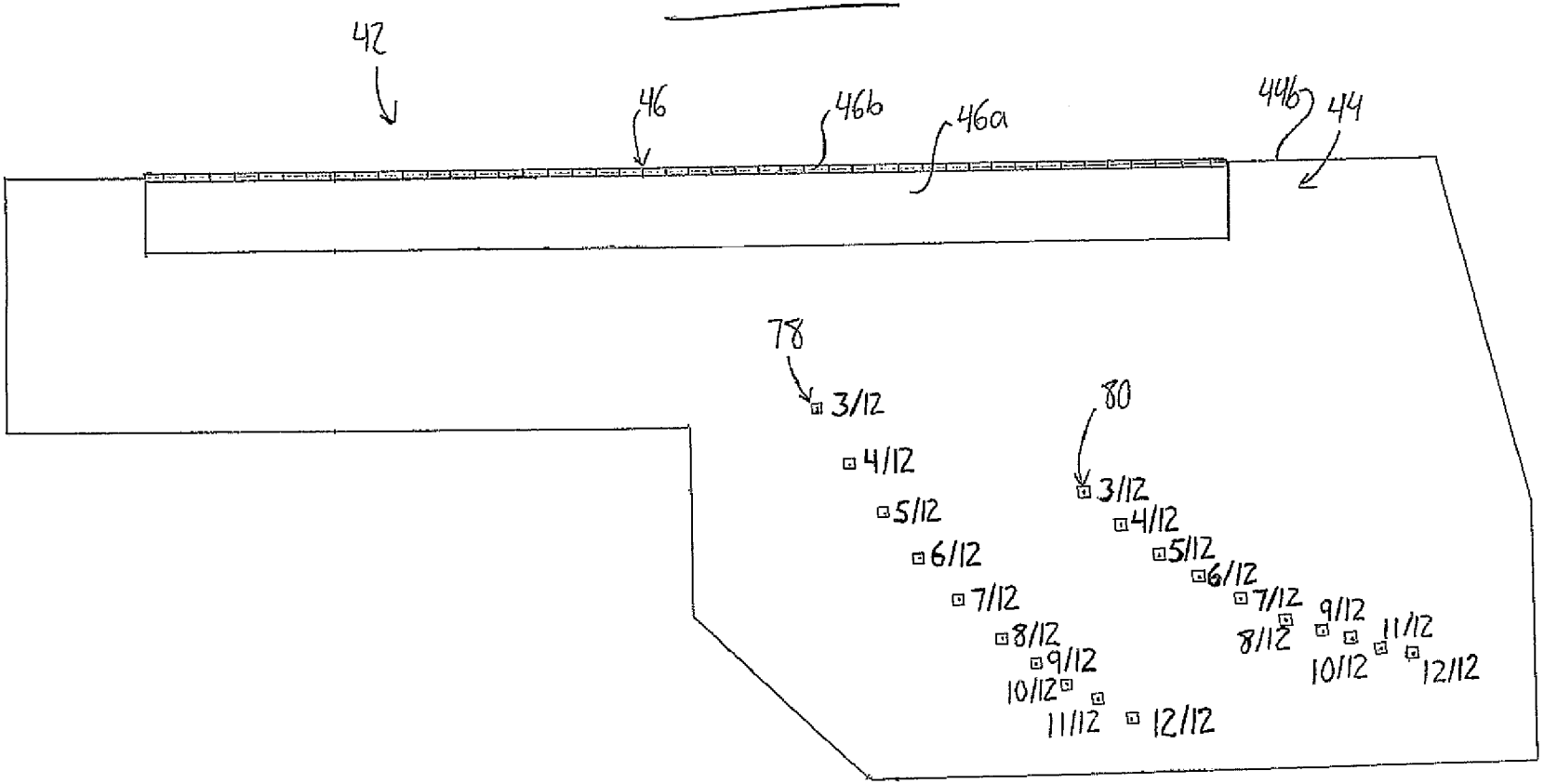
FIG. 4 is a side elevational view of a rafter bracket portion of the first embodiment fascia board support device for hanging from a roof rafter.
Figure 5:
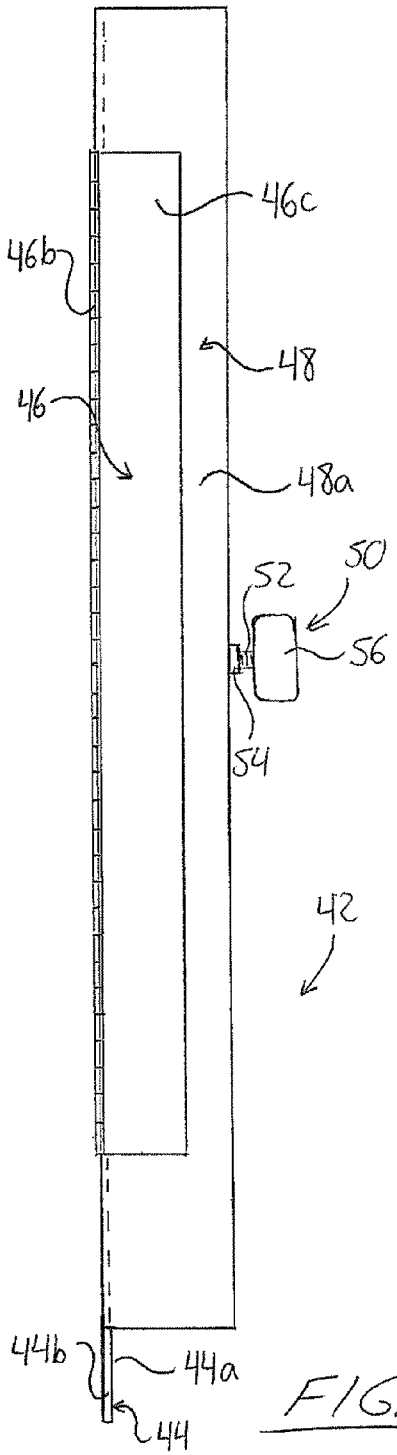
FIG. 5 is an overhead plan view of the rafter bracket portion of the first embodiment fascia board support device.
Figure 6:
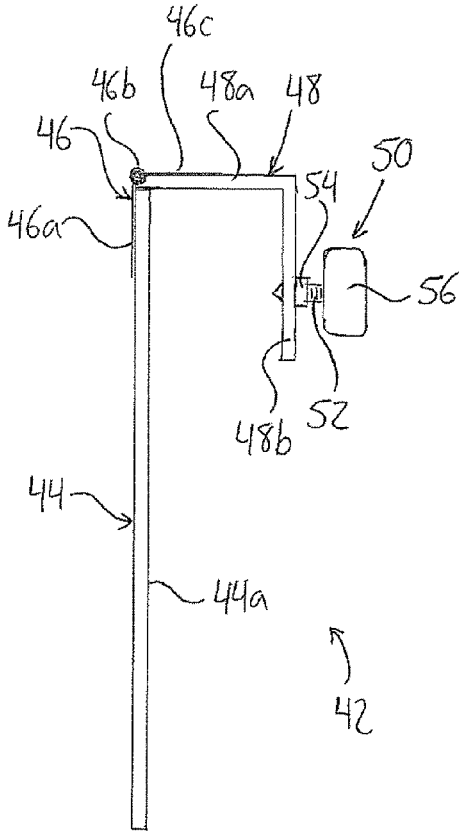
FIG. 6 is a front elevational view of the rafter bracket portion of the first embodiment fascia board support device.

FIGS. 4 to 6 show a rafter bracket portion 42 of the device 40 that is configured for selectively hanging from atop a rafter. A side of the rafter bracket portion 42 is defined by a flat plate 44 that is to be oriented vertically in use of the device 40 to present a planar vertical face 44*a* for placement against a side of the rafter 20 with a linear top edge 44*b* of this side plate 44 following the top corner edge of the rafter at the side thereof against which the plate 44 is disposed. A hinge 46 has its first leaf 46*a* fastened to the side plate 44 adjacent the top edge 44*b* thereof. The knuckle 46*b* and pin of the hinge extend along the top edge 44*b* of the side plate 44 and the second leaf 46*c* of the hinge is fastened to a right angle member 48 that is accordingly movable relative to the side plate 44 by pivoting of the hinge about its pivotal axis parallel to and just above the top edge 44*b* of the side plate 44.

The right angle member 48 is elongated in shape in a direction parallel to the pivotal axis and has an L-shaped cross-section in a plane normal thereto. First and second legs of the right angle member's cross-section are defined by respective rectangular planar portions of the member disposed at ninety degrees to one another. The second leaf 46*c* of the hinge is fixed to the first leg 48*a* of the right angle member so that the right angle member is pivotally movable into and out of a deployed position for use, shown in FIG. 6, where the first leg 48*a* projects normally away of the plane of the side plate 44 in a direction perpendicular to the top edge of the side plate 44 to carry the second leg 48*b* in a position parallel to the side plate 44 at a lateral distance from the side thereof to be placed against the rafter. In this position, the first leg 48*a* of the movable member 48 projects from the side plate 44 by a distance slightly exceeding the width of the rafter on which the device is to be used so that with the side plate 44 placed against the rafter, the first leg 48*a* spans over the rafter to the side thereof opposite the side plate 44 and the second leg 48*b* depends downward along this opposite side of the rafter.

A screw clamp mechanism 50 is provided on the second leg 48*b* of the movable right angle member 48 and is manually operable to tighten against the side of the rafter opposite the side plate 44 when the right angle member is deployed as described above. The screw clamp mechanism 50 features a screw 52 that passes normally through the planar second leg 48*b* of the movable member 48 via a hole therein, and in doing so has its threaded shaft matingly engaged with a threaded cylindrical passage provided by a nut 54 fixed to the second leg 48*b* of the movable member 48 with the opening of the nut in communication with the hole in the movable member. A handle 56 is fixed to an end of the screw on the side of the second leg 48*b* opposite that to which the first leg 48*a* projects for convenient manual rotation of the screw 52 to control linear displacement of the screw through the second leg 48*b* of the movable member 48. Rotating the handle 56 in a tightening direction displaces the screw 52 further through the hole, so that with the movable member deployed over the rafter, the end of the screw 52 opposite the handle 56 engages against the side of the rafter opposite the side plate 44 to clamp the hinged-together side plate and movable member to the rafter.

Figures 7, 8, 9:
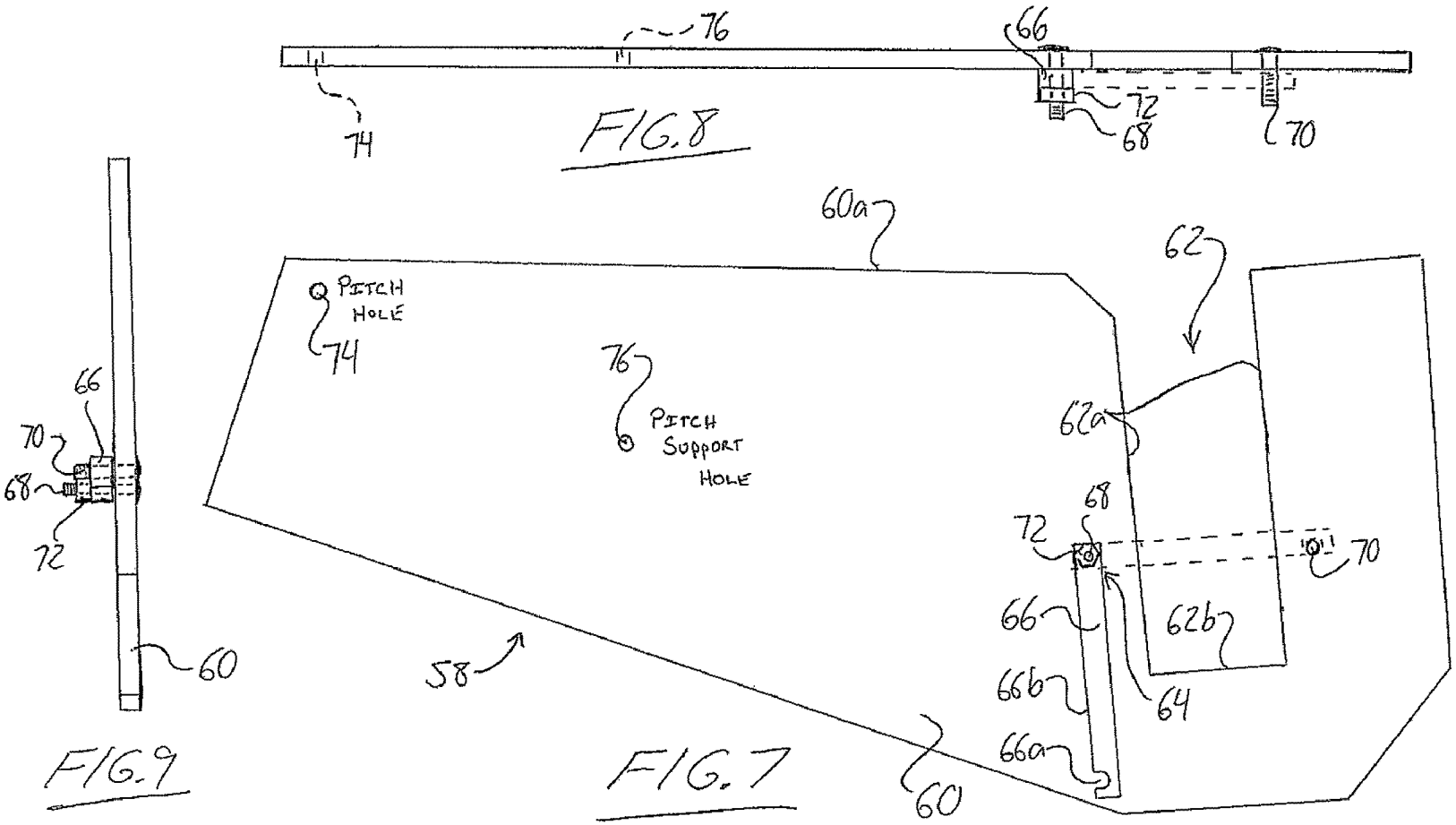
FIG. 7 is a side elevational view of a fascia board support portion of the first embodiment fascia board support device for carrying a fascia board on the rafter bracket portion.
FIG. 8 is an overhead plan view of the fascia board support portion of the first embodiment fascia board support device.
FIG. 9 is a front elevational view of the fascia board support portion of the first embodiment fascia board support device.

FIGS. 7 to 9 show a fascia board support portion 58 of the device that is attachable to the side plate 44 of the rafter bracket portion 42 in a number of different position and orientation pairings along the plane of the side plate 44 to position and orient the fascia support portion 58 according to a pitch angle of the rafters on which the device is to be used. The fascia support portion 58 features a support plate 60 having a slot 62 cut thereinto from an upper edge 58*a* thereof nearer one end thereof than another. A width of the slot measured along the plane of the support plate 60 in a direction perpendicular to the depth by which the slot projects into the support plate 60 is dimensioned to receive the thickness of a conventionally sized fascia board. The width of the slot is selected to slightly exceed this fascia board by a distance small enough so that a fascia board can be deposited within the slot without significant resistance and is placed and retained in an orientation substantially matching that of the slot once received therein. The parallel sides 62*a* of the slot 62 extend perpendicularly from the bottom 62*b* thereof to give most of the slot a rectangular shape following that of a fascia board's cross section, but as shown in the figures, the slot 60 may widen to the upper edge 60*a* of the support plate 60 from a short distance therebelow to ease insertion of the bottom of a fascia board into the slot 62.

A latch mechanism 64 is provided on the support plate 60 to allow user selection between different possible effective depths of the slot 62 according to the size of fascia board to be installed. A latch arm 66 is pivotally carried on a pivot pin 68 projecting normally from the support plate 60 at a position a short distance from the slot on the side thereof opposite the end of the support plate 60 closest to the slot. The arm 66 is pivotal about the axis of the pivot pin in a plane parallel to that of the support plate, and has an arcuate recess 66*a* formed in an otherwise linear edge 66*b* of the arm 66 that faces downward when the arm is pivoted into a deployed position extending perpendicularly across the slot 62, parallel to the flat bottom 62*b* of the slot at a distance thereabove. A catch pin 70 carried on the support plate 60 at a position across the slot 62 from the pivot pin 68 is received in the arcuate recess 66*a* when the latch arm 66 is pivoted into its deployed position. Pivoting of the arm 66 past the deployed position in one direction is blocked by the catch pin 70, and the arm is retractable from the deployed position by pivoting in the opposite direction As shown in the figures, the latch arm 66 of the first illustrated embodiment simply hangs downward from the pin in a position not obstructing the slot 62 when manually pivoted out of the deployed position by a sufficient amount. As shown, the pins may be provided by fasteners passing through the support plate 60 to present at least partially threaded shafts on the latch arm side of the support plate, and the pivot-defining fastener may be fitted with a nut 72 on the side of the latch arm 66 opposite the support plate 60 to retain the latch arm 66 on the fastener's shaft. When the latch arm 66 is not deployed, the slot bottom 62*b* defines a seat for a fascia board of a respective standard width. When the latch arm 66 is deployed, it defines a seat for a fascia board of a shorter respective standard width. The distance between the bottom 62*b* of the slot 62 and the flat linear top edge 66*c* of the latch arm 66 when deployed equals the difference between the two known fascia board widths, so that a fascia board of the smaller size seated on the latch arm 66 will project the same height from the slot 62 as would a fascia board of the larger size seated on the slot bottom 62*b*.

First and second through holes 74, 76 are provided in the support plate 60 at spaced apart positions between the slot 62 and the end of the support plate 60 furthest from the slot 62. As shown in FIGS. 1 and 4, the side plate 44 of the rafter bracket portion 42 of the device features first and second series of through holes 78, 80 therein, the holes of the first series 78 being spaced over a first path laid out along the plane of the side plate 44 and the second series of holes being spaced over a different second path laid out along the plane of the side plate 44. Each hole in one series is marked with an indicator reflecting a particular standard roof pitch and has a corresponding hole in the other series marked with a respective indicator reflecting the same particular roof pitch. In every such pair of corresponding holes in the two series, a straight-line center-to-center distance between the hole in the first series and the respective hole in the second series equals a straight-line center-to-center distance between the first and second through holes 74, 76 in the supporting plate 60 of the fascia supporting portion 58 of the device. Accordingly, the supporting plate 60 can be placed up against the face of the side plate 44 opposite the face 44*a* to be placed against the rafter and moved around the planar interface of these two plates to align the first and second holes 74, 76 in the supporting plate with any selected pair of same-pitch-label holes in the first and second hole series 78, 80 in the side plate 44.

With reference to FIG. 1, with the holes 74, 76 in the fascia support plate aligned with the hole pairing in the side plate 44 corresponding to the roof pitch of the rafter on which the device is to be temporarily mounted, a screw or bolt 82, 84 can be passed through the side and fascia support plates at the holes 74, 76 in the fascia support plate and fitted with matingly threaded nuts 86, 88 to secure the plates together in a face-to-face manner. With the two through-holes of the fascia support plate 60 being aligned with a respective one of the multiple pairs of holes in the side plate 44 corresponding to the pitch of the rafter on which the rafter bracket portion 42 of the device is temporarily mounted by cooperation of the clamping mechanism 50 with the side plate 44 and movable member 48, the position and angular orientation of the fascia board support plate 60 relative to the side plate in the interface plane at which the two plates 44, 60 are disposed face-to-face is such that the support plate 60 projects past the end of the side plate 44 nearest the outer end of the rafter to position the side of the slot 62 nearest the side plate 44 in the vertical plane of the outer end of the rafter, with the vertical plane in which the other of the two parallel slot sides lies intersecting the plane of the bottom face of the first leg 48*a* of the right angle member 48 at a vertical height from the top of this slot side to which a fascia board 20 placed against this slot side projects when seated in the slot to extend horizontally therethrough.

In FIG. 1, the latch arm 66 is deployed across the slot 62 to define a higher fascia board seat than the bottom of the slot 62*b* and thereby effectively shorten the slot 62 for use with a shorter of two fascia widths with which the illustrated device can be used. It will be appreciated that if a fascia board of the larger size was used, the latch would be retracted in order to seat the wider fascia board on the bottom 62*b* of the slot, in which case the wider fascia board would project the same height from the slot 62 as the illustrated narrower fascia board seated atop the latch arm 66. Accordingly, the user-selectable fascia board seats provided at different positions along the slot by the slot bottom 62*b* and the latch arm 66 allow a user to choose from predetermined effective depths of the slot that when receiving fascia boards of the corresponding predetermined width will position the top outer edge 20*a* of the fascia board in the same plane as the top of the rafter. Accordingly, planar sheets of roof decking or sheathing material will properly sit flush atop the rafters and not be lifted adjacent the rafter ends by an improperly positioned piece of fascia board projecting upward past the top of the rafter.

With a pair of devices temporarily fastened to spaced apart rafters in a roof structure and having their support plates secured to their side plates according to the roof pitch setting dictated by the rafter pitch and the latch arm deployed or not according to the size of fascia board being installed, a user can simply place the fascia board into the slots which will automatically seat the length of fascia board in a vertical orientation against the vertically oriented end of the rafter at the appropriate height to position the top outer edge of the fascia board in the plane of the top of the rafters. Accordingly, no further adjustment of the device or manual positioning of the fascia board is required, and the user can instead immediately fasten the fascia board to the rafters. After this fastening, the clamping mechanism 50 is loosened from against the rafter, the movable member 48 is pivoted by the user about the hinge axis to withdraw the movable member from about the top of the rafter so that the second leg of the movable member no longer depends downward on the side of the rafter opposite the side plate, and the device is then lowered along the side of the rafter to withdraw the slotted support plate 60 from around the now-installed fascia board to thereby complete the removal of the device from the roof structure. The devices can then be moved to other rafters of the same roof pitch and used again without any further adjustment, each requiring only movement of its movable member back into the deployed position over the new rafter and tightening of its clamping mechanism.

The two series of holes providing predetermined attachment point pairings marked according to the roof pitches for which they are configured provide ten such pairings in the first illustrated embodiment, the holes being labeled using conventional roof pitch notation in which a fraction indicates vertical rise, in inches, over horizontal run or span, in inches, and the holes in each series being labeled sequentially from 1/12 to 12/12 with 1-inch rise (numerator) increments and a constant fixed 12-inch run (denominator) moving downwardly away from the top edge of the side plate along a respective curved path moving toward the front end of the side plate 44 past which the support plate 60 projects to position the slot when secured in position on the side plate. It will be appreciated that the number of attachment point pairings may be altered to change the number and values of selectable pitches. Although the figures show the holes in the side plate 44 as being labeled on the side thereof against which the support plate 60 is to be placed, the pitch labels or markings are also or instead provided on the opposite side of the side plate 44 so as to be visible during installation of the support plate for use.

Although not illustrated as such, nuts used with screws or bolts to join the plates together at the desired attachment points may be provided in the form of wingnuts for easy manual tightening and loosening of the nuts. Other releasable fastening arrangements may alternatively be used for the selective securing together of the plates in the different pitch-specific positions, for example use quick release pin type fasteners. As an alternative to having holes at the two fixed attachment points on the support plate 60 for alignment with a hole pairing on the side plate for passage of fasteners through the aligned holes, studs or projections may be provided at the two attachment points on the support plate so as to be fittable into the holes of each hole pairing in the side plate. If threaded, the studs may receive nuts on the side of the side plate opposite the support plate to complete the reversible fastening. Alternatively, cross-bores through the studs at distances from the support plate may receive removable spring cotter pins on the side of the side plate opposite the support plate to complete the fastening together of the plates.

As an alternative to spaced apart holes at the predetermined attachment point pairings on the side plate, the side plate may instead feature two curved slots following the curved paths along which the holes of the first illustrated embodiment are disposed, with attachment points along each slot marked or labeled on the face of the side plate opposite the support plate to reflect places where the attachment point holes in the support plate should be aligned for threaded fastening of the plates together for use with the particular roof pitch reflected by the label. However, such an arrangement would require fine tuning or a higher degree of visual positioning of the two plates by the user to ensure accurate fastening together of the plates at the marked attachment points, as opposed to the first illustrated embodiment where attempting to pass fasteners through holes that need to be closely aligned before the fastener will pass through allows the user to "feel out" the aligned positions where the fastener will pop through the aligned holes.

In another alternative embodiment, the holes in the side plate need not be entirely closed off or separate or distinct from one another, in that narrow slots of insufficient width to accommodate a fastener therethrough could interconnect the holes, which despite being connected would still define distinct predetermined attachment points selectable by the user and alignable with the support plate attachment features by feel. Even if interconnected by slots sufficiently wide to accommodate the fastener, the "holes" could still define user-selectable points alignable with the support plate attachment features by feel, for example by having the slots not follow the path along which the attachment points are located so that the "holes" at the attachment points jut out from the slots like notches so that pulling a fastener into the notch lets the user know by feel that the fastener is in place so that one of plates can be pivoted about the fastener relative to the other plate to bring the other hole in the support plate into alignment with the other "hole" or notch of the desired pairing of attachment points.

In another alternative embodiment, the first leg of the movable member of the first illustrated embodiment may be replaced with a plate or flat-bottomed member rigidly fixed to the side plate to project to the side thereof opposite the support plate by a distance sufficient enough to span over the top of the rafter to the side thereof opposite the side plate. The pivotal hinge connection would then be found on this fixed projection at the end thereof opposite the side plate, where the hinge would carry another flat plate member replacing the second leg of the movable member of the first illustrated embodiment. This further plate member would carry the clamping mechanism and be movable between a deployed position projecting downward from the axis of the hinge on the member rigidly fixed to the side plate and a retracted position not projecting downward from the hinge axis. However, the fixed piece extending over the top of the rafter would prevent lowering of the device directly off the rafter after installation of the fascia board. While removal of the device could be facilitated by detaching the support plate from the side plate and removing the support plate from under the fascia board to allows subsequent lifting of the rafter bracket portion from off the rafter, this would be less efficient than use of the first illustrated embodiment, as re-attachment of the support plate would be needed for subsequent use on another rafter of the same pitch.

The first illustrated embodiment uses a single latch to provide the user with selection from among two possible fascia board widths, for example 2×6 inch and 2×8 inch fascia boards. Other embodiments may employ additional latches to allow user-selection from more than two possible effective slot depths corresponding to particular board dimensions. For example, cabin latches use latch arms with an eyelet end closing through a ring and a hook end selectively passable through another ring. As such latches are not limited to purely pivotal motion like the latch arm of the first illustrated embodiment, a series of two or more of them could be installed at different heights along the slot in the support plate and each be operable to engage its hook end through a respective ring on the opposite side of the slot without blocking or interfering with operation of the other latch arm(s) when hanging free and not deployed across the slot. Other known ways of adjusting the slot depth may alternatively be applied, for example by a slider adjustment as taught in U.S. Pat. No. 6,513,286 or 5,288,667 or a riser insert as taught in U.S. Pat. No. 6,240,702. However, the latch system of the first illustrated embodiment has the advantage that the latches are in predefined positions requiring no visual positioning or fine tuning by the user and can be permanently secured to the device to prevent loss.

Prototypes of the present invention have been produced using sheet metal to form plates. However, it will be appreciated that other materials, such as plastic, may alternatively be used to produce the device. Also, it will be appreciated that the components need not necessarily have the relative thin plate structures illustrated and described, as other three dimensional shapes may be employed but still provide a flat face or other structure with coplanar surface areas for bearing against for bearing against the side of the rafter, a flat face or other coplanar configuration of surface areas for placement against the top of the rafter, a movable member operable to depend down the opposite side of the rafter and a fascia board carrier having a slot therein to receive a fascia board. However, relatively thin plate-like components provide an overall compact, lightweight structure that is efficient to store, transport and handle during use. The pitch markings may be stamped into the material, printed thereon or applied thereto using separately printed labels.

Figure 10:
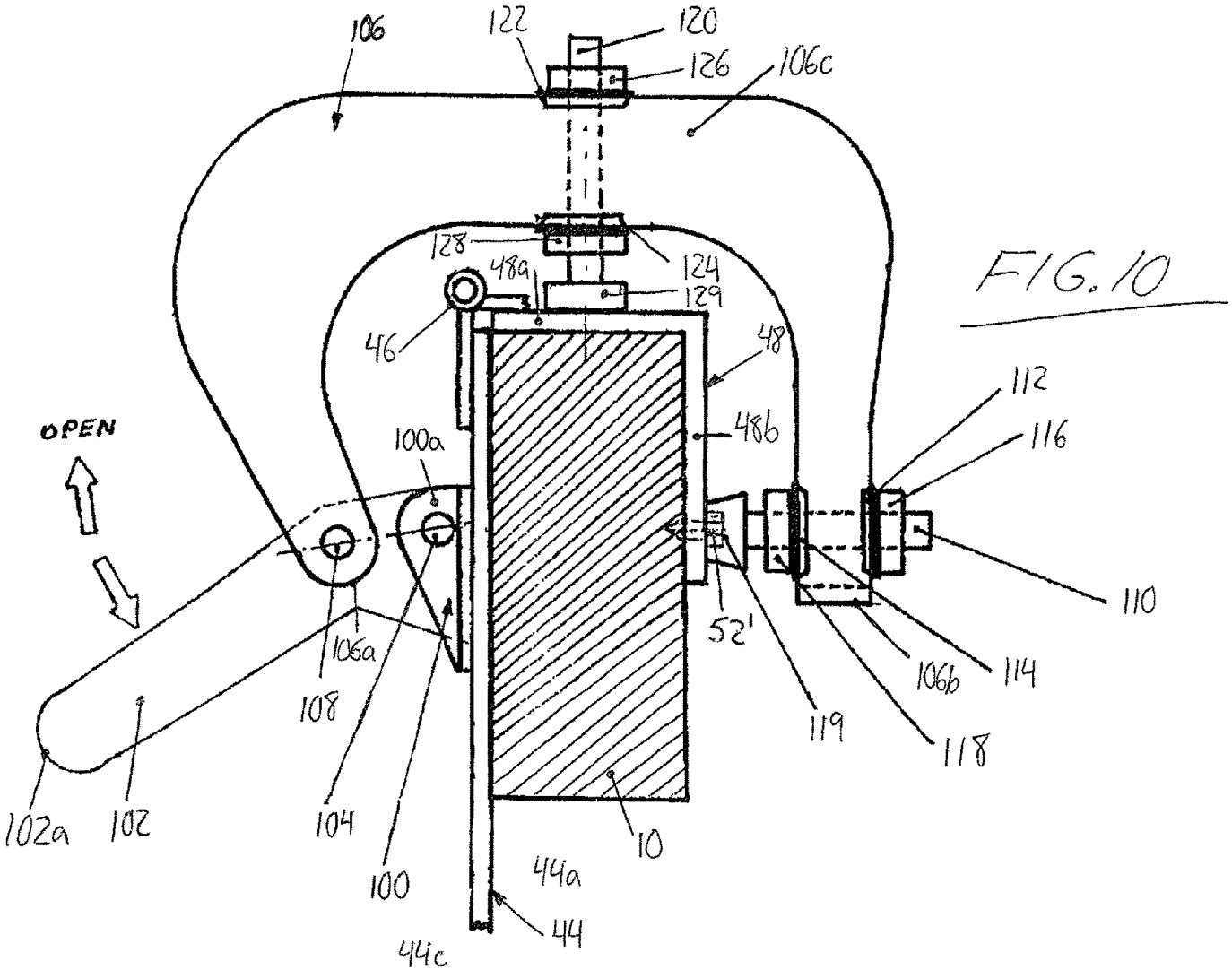
FIG. 10 is a front elevational view of a rafter bracket portion of a second embodiment fascia support device using a toggle clamp arrangement to facilitate simple lever-actuated clamping and release of the device on a rafter.
Figure 11:
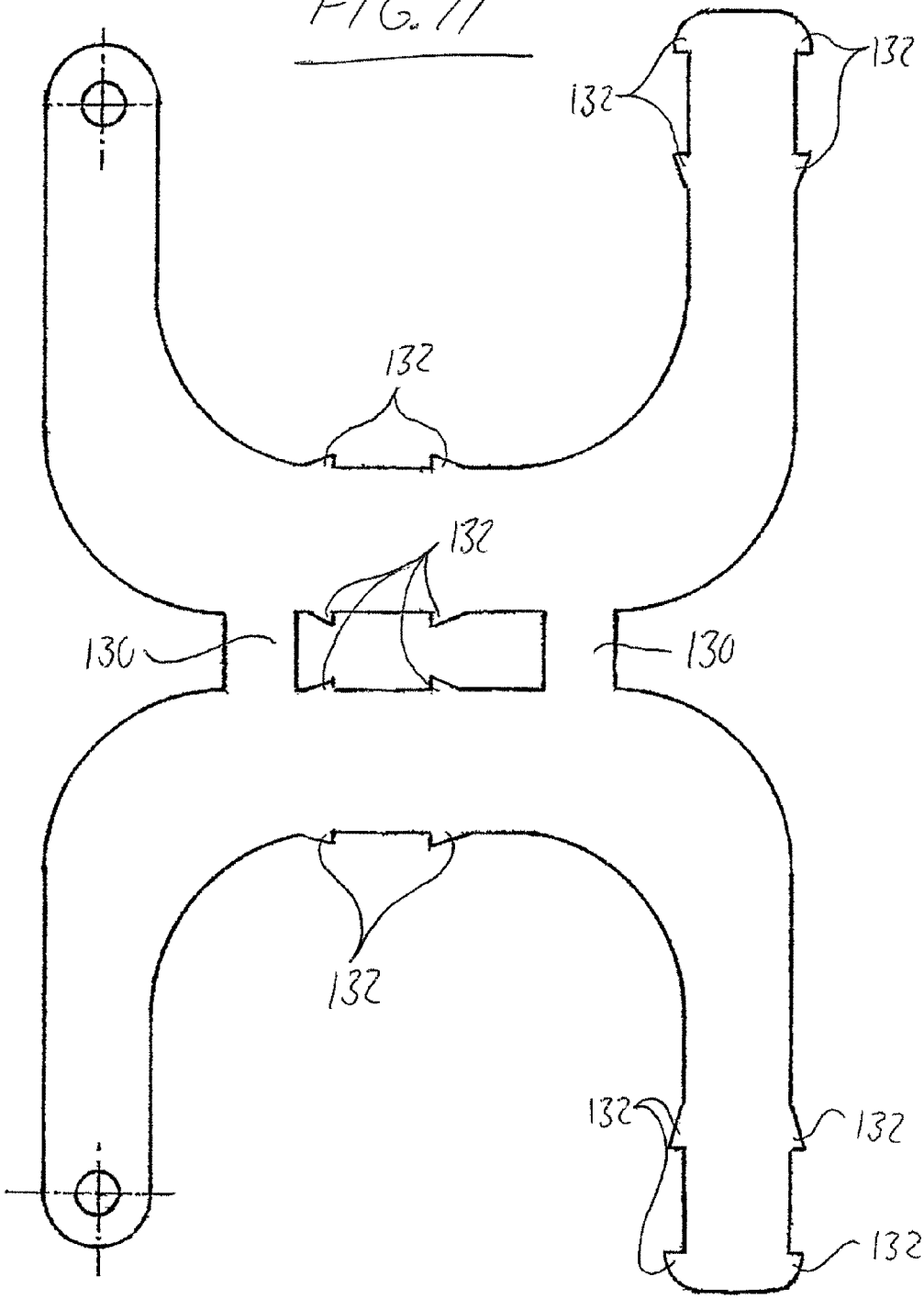
FIG. 11 is a plan view of a sheet metal design that may be employed to form a clamp arm of a toggle clamp arrangement similar to that of FIG. 10.

FIG. 10 presents a second illustrated embodiment in which the rotationally driven screw type clamp of the first embodiment has been replaced with a lever-driven toggle clamp for quick and easy clamping and release of the device's installed position on the rafter 10 by simple pivoting of an actuating lever of the toggle clamp.

The second embodiment features the same fascia board support portion (not shown) and rafter bracket portion as the first embodiment, except that the nut 54 fixed on the second leg 48*b* of the movable right angle member 48 to provide a threaded passage is not used since no screw clamp mechanism requiring a threaded passage is included. A screw 52' still passes through the hole in the second leg 48*b* of the right angle member 48 however, in order to provide a point or spike projecting toward the side plate 44 when the right angle member is deployed over the rafter 10 to bite into the side of the rafter when the toggle clamp is closed to best fix the clamped in place position of the device.

The toggle clamp mechanism features a lever mounting bracket 100 fixed to the outer face 44*c* of the side plate 44 opposite the inner face 44*a* to be placed in contact against the rafter 10. The lever mounting bracket presents two lugs 100*a* horizontally spaced apart from one another and projecting outward from the side plate 44 in planes perpendicular thereto. Aligned through-holes pass perpendicularly through the two parallel lugs 100*a* along an axis parallel to the pivot axis of the hinge 46 a short distance outward from the plane of the side plate 44. An actuating lever or toggle arm 102 has an end thereof received between the lugs 100*a* with a through-hole near this end of the lever 102 aligned with the through holes in the lugs, and a first pivot pin 104 passes through the three aligned holes to define a pivot axis of the lever parallel to the hinge axis of the movable member 48. The actuation lever 102 is thus pivotable about the axis of the first pivot pin 104 for pivotal motion relative to the side plate 44.

A clamping arm assembly 106 features two identical plate-like arms that each have a generally C-like shape and are horizontally spaced apart by a small distance, like the lugs 100*a* of the lever mounting bracket 100, but are fixed together with their peripheral edges aligned for movement as a single C-shaped arm unit. Aligned through holes in the two fixed together C-shaped arms 106 proximate a first end 106*a* of the C-shape align with a respective second through-hole in a portion of the actuating lever received between the plate-like arms 106 so that a second pivot pin 108 passes through these three aligned holes along an axis parallel to that of the hinge 46 and the first pivot pin 104. The C-shaped arm assembly 106 is thus pivotal relative to the actuating lever 102 about the second pivot axis provided by the second pivot pin 108 positioned further outwardly from the side plate 44 than the first pivot pin 104.

Adjacent a second end 106*b* of the C-shaped arm assembly 106 opposite the first end 106*a*, a threaded spindle 110 passes between the two C-shaped arms and is secured to the arms by clamping of the arms between two washer/nut pairings, one to the outside of the arms' C-shape and one to the inside thereof. That is, an outer washer 112 disposed around the spindle 110 seats against an outer peripheral edge of each C-shaped arm plate and an inner washer 114 disposed around the spindle 110 rests against an inner peripheral edge of each C-shaped arm plate. An outer nut 116 threaded onto the spindle 110 against the outer washer 112 and an inner nut 118 having been threaded onto the spindle to reside on a side of the inner washer 114 opposite the outer nut 116 are located at threaded positions along the spindle 110 where one nut has been sufficiently threaded toward the other to tightly clamp the second end portion of the C-shaped arm unit 106 between the inner and outer nut/washer pairings, and thereby secure the spindle 110 to the C-shaped arm unit 106.

With the nut/washer pairings situated on opposite sides of the second end portion of the C-shaped arm unit 106 to face into and out of the space bordered by the C-shape, one end of the spindle 110 thus projects from this second end portion of the C-shape inwardly into the space between the opposing ends of the C-shape, in a direction toward the first end 106*a* thereof. This inner end of the spindle 110 is equipped with a cap 119 of neoprene or other flexible resilient material.

A second such capped projection is similarly mounted on a central portion 106*c* of the C-shaped arm unit that interconnects the two end portions of the C-shape and extends perpendicular to the second end portion from which the spindle 110 of the first capped projection perpendicularly extends.

In the same manner as the first, the second capped projection also features a threaded spindle 120 passing between the two C-shaped arms and secured to the arms by clamping of the arms between two washer/nut pairings, one on the outside of the arms' C-shape and one on the inside thereof. That is, an outer washer 122 disposed around the spindle 110 seats against an outer peripheral edge of each C-shaped arm plate and an inner washer 124 disposed around the spindle 120 rests against an inner peripheral edge of each C-shaped arm plates. An outer nut 126 threaded onto the spindle 120 against the outer washer 122 and an inner nut 128 having been threaded onto the spindle to reside on a side of the inner washer 124 opposite the outer nut 126 are located at threaded positions along the spindle 120 where one nut has been sufficiently threaded toward the other to tightly clamp the second end portion of the C-shaped arm unit 106 between the inner and outer nut/washer pairings, and thereby secure the spindle 120 to the C-shaped arm unit 106.

With the nut/washer pairings on opposite sides of the central portion 106*c* of the C-shaped arm unit 106 to face into and out of the space bordered by the C-shape, one end of the spindle 120 thus projects from this central portion 106*c* of the C-shape inwardly toward the space between the opposing ends of the C-shape toward at the open side thereof. The second spindle thus projects in a direction perpendicular to the first, and the inner end of the second spindle 120 is likewise equipped with a cap 129 of neoprene or other flexible resilient material.

FIG. 10 shows the second embodiment device in an in-use position with the clamping mechanism in a clamping condition where the actuating lever 102 is in a self-locked lowered position, in which further downward pivoting of a handle end 102*a* of the lever 102 about the axis of the first pivot pin 104 is blocked by abutment of a flat edge of the other end of the lever against the outer face 44*c* of the side plate 44. The upper corner of this end of the lever is arcuately curved (radiused) around the axis of the pivot pin 104 from the flat edge that abuts against the side plate 44 when the lever is in this position so that the lever can be pivotally raised out of this position about its pivot axis.

To achieve the clamping condition shown in FIG. 10, the rafter bracket portion of the device was first placed on the rafter in the same manner as the first embodiment, thereby positioning the side plate 44 against one side of the rafter with the movable member 48 deployed over the top edge of the rafter to depend downward on the opposite side thereof. With the actuating lever in a raised position situating the second pivot pin 108 at an elevation above that of the first pivot pin 104, the C-shaped arm assembly 106 is also positioned to also extend over the top edge of the rafter so that the second end portion of the C-shaped arm assembly depends downward on the second side of the rafter to the outside of the second leg 48*b* of the movable member 48 of the rafter bracket. At this point, with the pivot pin 108 of the C-shaped arm unit 106 elevated sufficiently above the position shown in FIG. 10, so as to be closer to the side plate 44 on a circular path around the first pivot pin 104, the caps 119, 129 of the two projections on the C-shaped arm unit 106 would be upwardly and laterally outwardly from the first and second legs 48*a*, 48*b* of the movable member 48 respectively. Pulling the handle end 102*a* of the actuating lever 102 downward about the first pivot pin 104 to the position shown in FIG. 10 moves the second pivot pin 108 arcuately about the first pivot pin 104 to a lower position, thus drawing the cap 119 on the first spindle 110 toward the rafter 10 to clamp the second leg 48*b* of the movable member against the second side of the rafter, and drawing the cap 129 on the second spindle 120 downward toward the top edge of the rafter to clamp the first leg 48*a* of the movable member against this top rafter edge.

With at least one set screw 52' passing through the second leg 48*b* of the movable member, or preferably more than one such set screw, for example two such screws on opposite sides of where the cap 119 of the first spindle 110 urges the second leg 48*b* of the movable member against the rafter, the sharp tip of each such screw bites into the wood of the rafter to cooperate with the force of the clamping mechanism that drives this tip into the rafter material to firmly secure the device in place on the rafter.

After use of the device in positioning and supporting a fascia board during installation thereof, the force of the toggle clamp securing the device on the rafter is released by raising the handle end 102*a* of the actuation lever 102 out of the fully lowered clamping position of FIG. 10 to raise the pivot point of the C-shaped arms 106 and thus remove the resilient caps from their tight gripping condition forced against the outer faces of the movable member 48. With the handle raised in this manner into a releasing position, the user can then withdraw the C-shaped arm unit 106 from its useful position spanning over the rafter by flipping it thereover to the outer side of the side plate 44 at which the mounting bracket is fixed. To complete the withdrawal of the entire device from atop the rafter, the movable member 48 is likewise withdrawn out its deployed position spanning about the top of the rafter by also flipping it back to the outer side of the side plate 44, at which point the device is free to be lowered along the rafter to withdraw the device from beneath the installed fascia board since no part of the device now overlies the rafter's top edge.

The toggle clamp lever, arm unit, and mounting bracket may all be produced using sheet metal, which may for example be aluminum. FIG. 10 shows a sheet metal design for production of a C-shaped arm assembly from a single integral sheet of material cut to form two generally C-shaped sections integrally interconnected by two short strips or tabs 130 at the central portion of each C-shape on opposite sides of where the top spindle is to be mounted to the final arm unit. The design also shows how the sheet material can be cut to leave tangs 132 projecting outward from the remainder of the peripheral edges of the C-shaped sections to leave an effectively recessed portion of the peripheral edge between a pair of adjacent tangs. The recessed portions between the tangs of two respective tang pairs that will align when the cut-sheet is bent to right angles at the ends of the two tabs to face the two C-shaped sections toward one another define a seat for receiving a washer of a respective spindle projection assembly to positively position this assembly at a selected suitable location along the arms' C-shape.

It will be appreciated however that the toggle clamping components need not necessarily have a sheet-material structure, that the arm structure need not necessarily be formed as two aligned plate-like arms, and that other ways of forming inwardly extending projections on the C-shaped arm structure to carry preferably flexible and resilient gripping members for abutting against the movable member in a clamping function may alternatively be employed while still providing the benefit of a toggle clamp by which quick engagement and disengagement of the clamp is attained by mere pivoting of a lever in opposing directions to make installation and removal of the device easier than screw-based clamping embodiments requiring manual rotation of an clamping actuator.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A fascia board support device for removable attachment to a roof rafter adjacent an end thereof to support a fascia board during attachment thereof to said end of the rafter, the device comprising:

a rafter bracket comprising:

a side member presenting a flat face for placement against one vertical side of the roof rafter; and a movable member coupled to the side member through a pivotal connection and pivotally movable relative to the side member about a pivot axis parallel to the flat face thereof into and out of a deployed position in which at least a portion of the movable member projects downward below the pivot axis at a lateral distance from the side member to depend downward on an opposing side of the roof rafter;

a clamping mechanism carried on the rafter bracket and operable to tighten toward the side member from the opposing side of the roof rafter with the movable member in the deployed position to selectively secure the rafter bracket to the roof rafter; and a fascia board support carried on the side member, projecting past an end thereof and featuring a slot situated past said end of the side member and dimensioned to receive a bottom of the fascia board therein to seat the fascia board at the end of the roof rafter.

2. The device according to claim 1 wherein the pivotal connection is disposed at the top of the side member and the movable member comprises first and second sections arranged to respectively project away from the side member over the roof rafter and depend downward along the flat face of the side member on the opposing side of the roof rafter with the movable member in the deployed position.

3. The device according to claim 1 wherein the movable member comprises a right angle member having first leg attached to the side member by the pivotal connection and a second leg projecting from the first leg at a right angle thereto at an end thereof opposite the pivotal connection.

4. The device according to claim 1 wherein the fascia board support is selectively movable relative to the side member to change both a relative angle at which the fascia board support projects past the end of the side member and a position at which the fascia board is disposed relative to the side member in a plane parallel to the flat face thereof.

5. The device according to claim 4 wherein attachment point paths laid out along the side member at spaced apart positions along the plane parallel to the flat face have pairs of first attachment points thereon, each pair of first attachment points featuring a respective attachment point on each of the attachment point paths and the attachment points of each pair of first attachment points being spaced apart by a same linear distance, and wherein a pair of second attachment points defined on the fascia board support are spaced apart by the same linear distance and attachment of the fascia board support to the side member with the pair of second attachment points aligned with a respective one of the pairs of first attachment points orients the slot in the fascia board support vertically with the pivot axis at a slope matching a respective roof rafter pitch.

6. The device according to claim 5 wherein first attachment elements at the first attachment points are cooperable with second attachment elements at the second attachment points to facilitate fastening together of the fascia board support and the side member.

7. The device according to claim 6 wherein the first attachment elements comprise holes in the side member sized for receipt of fastener elements therein.

8. The device according to claim 7 wherein the second attachment elements comprise holes in the fascia board support for passage of the fastener elements through the holes in the fascia board when aligned with the holes in the side member at one of the pairs of first attachment points.

9. The device according to claim 5 wherein a fascia board seat defined in the slot of the fascia board holder is positioned to intersect an axis extending along a side of the slot opposite the side member with a plane that contains the pivot axis and is normal to the flat face of the side member at a height from the seat equal to a fascia board depth.

10. The device according to claim 9 wherein a position along the slot at which the fascia board seat is situated can be changed by a user of the device for use with different fascia board depths.

11. The device according to claim 10 wherein the position of the fascia board seat along the slot is selectable only from fixed predetermined positions therealong, each of which corresponds to a known fascia board depth.

12. The device according to claim 10 comprising a latch movable between a support position spanning across the slot in a direction parallel to a bottom of the slot at a distance therefrom and a storage position leaving the slot unobstructed, whereby the latch defines an upper fascia board seat for a first fascia board depth when in the support position and the bottom of the slot defines a lower fascia board seat for a second smaller fascia board depth when the latch is in the storage position.

13. The device according to claim 5 wherein the pairs of first attachment points are labeled with indications of the respective roof rafter pitches.

14. The device according to claim 1 wherein the clamping mechanism comprises a quick lock quick release clamping mechanism.

15. The device according to claim 1 wherein the clamping mechanism comprises a toggle clamp operable by movement of an actuating lever.

16. The device according to claim 15 wherein the actuating lever is pivotally secured to the side member at a position opposing the flat face thereof and the toggle clamp comprises a C-shaped arm having a first end pivotally coupled to the actuating lever, the actuating lever being pivotable into a raised position in which the C-shaped arm is pivotable over the movable member of the rafter bracket when deployed to position a second end of the C-shaped arm on a side of the depending portion of the movable member opposite the side member, the C-shaped arm having a projection extending toward the first end from proximate a second end portion of the C-shaped arm opposite the first end so that movement of the actuating lever from the raised position to a lower locking position tightens the projection against the depending portion of the deployed movable member.

17. The device according to claim 16 comprising a second projection carried on a central portion of the C-shaped arm that overlies the movable portion of the rafter bracket when the movable portion is deployed and the C-shaped arm is pivoted thereover, the second projection extending toward an open side of the C-shaped arm to tighten the second projection downward onto the movable member from above the rafter under movement of the actuating lever to the lower locking position.

18. A fascia board support device for removable attachment to a roof rafter adjacent an end thereof to support a fascia board during attachment thereof to said end of the rafter, the device comprising:

a rafter bracket arranged for releasable attachment to the roof rafter adjacent the end thereof and defining a flat face for placement against one vertical side of the roof rafter and a downward facing surface for seating atop the rafter; and a fascia board support carried on the rafter bracket, projecting past an end thereof and featuring a slot situated past said end of the rafter bracket and dimensioned to receive a bottom of the fascia board therein to seat the fascia board at the end of the roof rafter;

attachment point paths laid out along the rafter bracket at spaced apart positions along a plane parallel to the flat face and having pairs of first attachment points, each pair of first attachment points featuring a respective attachment point on each of the attachment point paths and the attachment points of each pair of first attachment points being spaced apart by a same linear distance; and a pair of second attachment points defined on the fascia board support and spaced apart by the same linear distance so that attachment of the fascia board support to the rafter bracket with the pair of second attachment points aligned with a respective one of the pairs of first attachment points acts to orient the slot vertically with the downward facing surface oriented at a slope corresponding to a respective rafter pitch and to position the slot such that an axis extending along a side of the slot opposite the rafter bracket intersects a plane of the downward facing surface of the rafter bracket at a height from the seat equal to a fascia board depth.

19. A fascia board support device for removable attachment to a roof rafter adjacent an end thereof to support a fascia board during attachment thereof to said end of the rafter, the device comprising:

a side member presenting a contact face for placement against one vertical side of the roof rafter; and a clamping mechanism carried on the rafter bracket and operable to tighten toward the side member from the opposing side of the roof rafter with the movable member in the deployed position to selectively secure the rafter bracket to the roof rafter;

a fascia board support carried on the side member, projecting past an end thereof and featuring a slot situated past said end of the side member and dimensioned to receive a bottom of the fascia board therein to seat the fascia board at the end of the roof rafter; and a toggle clamp comprising an actuating lever pivotally secured to the side member at a position opposing the contact face thereof and a C-shaped arm having a first end pivotally coupled to the actuating lever, the actuating lever being pivotable into a raised position in which the C-shaped arm is pivotable over a top edge of the side member to extend laterally therepast by a distance exceeding a width of the roof rafter to position a second end of the C-shaped arm on a side of the roof rafter opposite the side member, the C-shaped arm having a second end carrying a clamping feature directed toward the first end so that movement of the actual lever from the raised position to a lower locking position pulls the clamping feature toward the side member to tighten against the roof rafter from the side thereof opposite the side member.

20. The device according to claim 18 comprising holes at one or both of the first attachment points and the second attachment points and further comprising fastener elements passable through said holes for use in fastening the fascia board support and the side member together.

* * * * *